US005322049A

United States Patent [19]

Dunlap

[11] Patent Number: 5,322,049

[45] Date of Patent: Jun. 21, 1994

[54] TENSIONABLE MEMBER FOR AN ARCHERY BOW AND METHOD OF CONSTRUCTION

[76] Inventor: Patrick J. Dunlap, 13290 Table Rock Rd., Central Point, Oreg. 97502

[21] Appl. No.: 986,342

[22] Filed: Dec. 7, 1992

[51] Int. Cl.[5] ..... F41B 5/00

[52] U.S. Cl. ..... 124/90; 87/7; 87/8

[58] Field of Search ..... 124/90, 86, 80; 87/13, 87/8, 9, 2, 7, 6; 289/1.5; 24/115 H, 115 K; 29/433, 728; 403/209, 210, 212, 214, 215, 216, 185, 291

[56] References Cited

U.S. PATENT DOCUMENTS

| | | | |
|---|---|---|---|
| 206,059 | 7/1878 | Treisilian | 403/210 |
| 2,226,529 | 12/1940 | Austin | 124/90 |
| 2,508,521 | 5/1950 | Lay . | |
| 2,600,395 | 6/1952 | Domoj et al. . | |
| 2,921,572 | 1/1960 | Miller | 124/90 |
| 3,097,474 | 7/1963 | Rohdenburg | 403/209 |
| 3,854,767 | 12/1974 | Burnett . | |
| 4,640,178 | 2/1987 | Kurzbock | 87/8 |
| 4,702,067 | 10/1987 | Izuta | 124/90 |
| 4,754,685 | 7/1988 | Kite | 87/8 |
| 5,056,498 | 10/1991 | Scherz | 124/90 |

FOREIGN PATENT DOCUMENTS 2945708 5/1981 Fed. Rep. of Germany ..... 87/8

OTHER PUBLICATIONS

Handbook of Polymer Science and Technology, vol. 2, Performance Properties of Plastics and Elastomers 1989, pp. 361-364.

*Primary Examiner*—Randolph A. Reese
*Assistant Examiner*—Anthony Knight
*Attorney, Agent, or Firm*—James D. Givnan, Jr.

[57] ABSTRACT

A tensionable member is disclosed for installation on an archery bow as a bowstring or a cable of a compound bow. The tensionable member has an outer tubular component of braided construction and a core of multiple strands. A suitable material is polyethylene fiber for use in both the tubular outer member and the core. End loops are formed on the tensionable member by reversing the ends of same and inserting the ends back into the tubular member. A locking element passes transversely through the reversed and inserted end segment and through the tubular outer member to retain the loop configuration. A modified form of tensionable member includes provision for retention of a sight and includes a sight retainer member having its ends secured within the tubular outer member by locking elements passing therethrough. The locking elements are of a fusible material to facilitate securement.

9 Claims, 1 Drawing Sheet

TENSIONABLE MEMBER FOR AN ARCHERY BOW AND METHOD OF CONSTRUCTION

BACKGROUND OF THE INVENTION

The present invention concerns bowstrings and cables used in archery bows and crossbows.

With regard to bowstrings little consideration has been to the relationship of drag exerted by air on multistrand bowstrings and its adverse effect on arrow velocity. Additionally of interest to bow hunters is the noise made by a bowstring when released which noise can result in spooking of game. Known bowstring and cable designs include multiple strands of synthetic material which are wrapped at their end segments to form looped ends for attachment to a bow and at their midpoints for arrow engagement. Accordingly substantial drag is encountered as the strands tend to disperse as disclosed in high speed photographs. Other disadvantages include high cost of manufacture and elongation.

U.S. Pat. No. 3,854,767 is of some interest in that it shows the formation of a loop by reinserting an end segment back into the major segment of the rope. A ferrule with projections, in place on the inserted segment, prevents slippage. U.S. Pat. No. 2,600,395 is of some interest in that it shows the formation of a loop by an end segment which itself is threaded back and forth through a primary portion of a length of braided material. U.S. Pat. No. 2,508,521 shows a length of tubular sheathing for partial sheathing of a bowstring of multiple strands to protect the strands and aid in uniform tensioning of same. External wrapping secures the sheaths in place after drawing of the strands through the sheathing. No reduction in recoil is mentioned and the un-sheathed segments of the bowstring will still disperse during bowstring release.

SUMMARY OF THE PRESENT INVENTION

The present invention is embodied in a tensionable tubular member, and method of construction, for use as a bowstring or as a cable in a compound bow, and having end segments which are looped for attachment purposes.

The present member is of tubular braided construction using a synthetic fiber of high molecular weight. A core is utilized which is of multiple strands of high modular synthetic fibers and which are put under tension and treated with a lubricant solution prior to being fed into the center of a braiding machine. Tensioning of the core assures proper fiber distribution.

For bow attachment purposes the present member is provided with loops at each of its ends with each loop formed by a reversed segment which has an end segment which is inserted back into the main part of the tensionable member to provide an interiorially located end segment. Securement of the end segment in place within the main portion of the tensionable member is achieved by a locking member inserted crosswise through the end segment and a surrounding portion of the tensionable member. The tensionable member core is of synthetic fibers of high molecular type.

Important objectives of the present invention include the provision of a tensioned member for an archery bow or crossbow which member is of a compact nature to reduce drag encountered by prior art bowstrings; the provision of a tensionable member for a bow which is of tensile strength and life exceeding that of known counterparts; the provision of a tensionable member for use in a bow that minimizes recoil and the sound of the tensionable member when released to avoid the spooking of game; the provision of a tensionable member which includes interiorly located end segments secured in place with a crosswise orientated locking element having fused ends; the provision of a braided member of lesser diameter than its counterparts to reduce drag.

Figure 1:
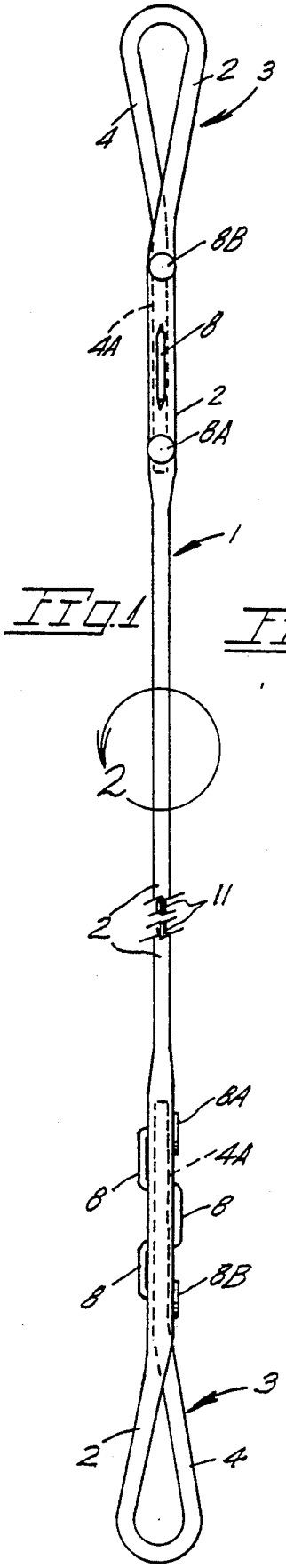
FIG. 1 shows a tensionable member removed from bow construction.
Figure 2:
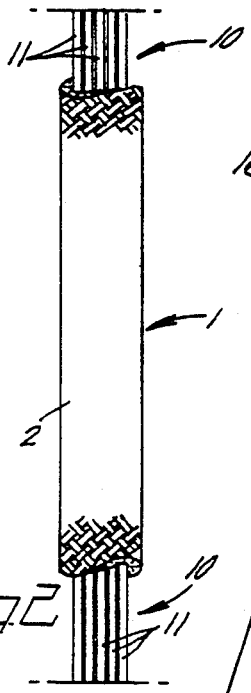
FIG. 2 is an enlarged fragmentary view of that loop portion of the tensionable member encircled at 2 in FIG. 1.
Figure 3:
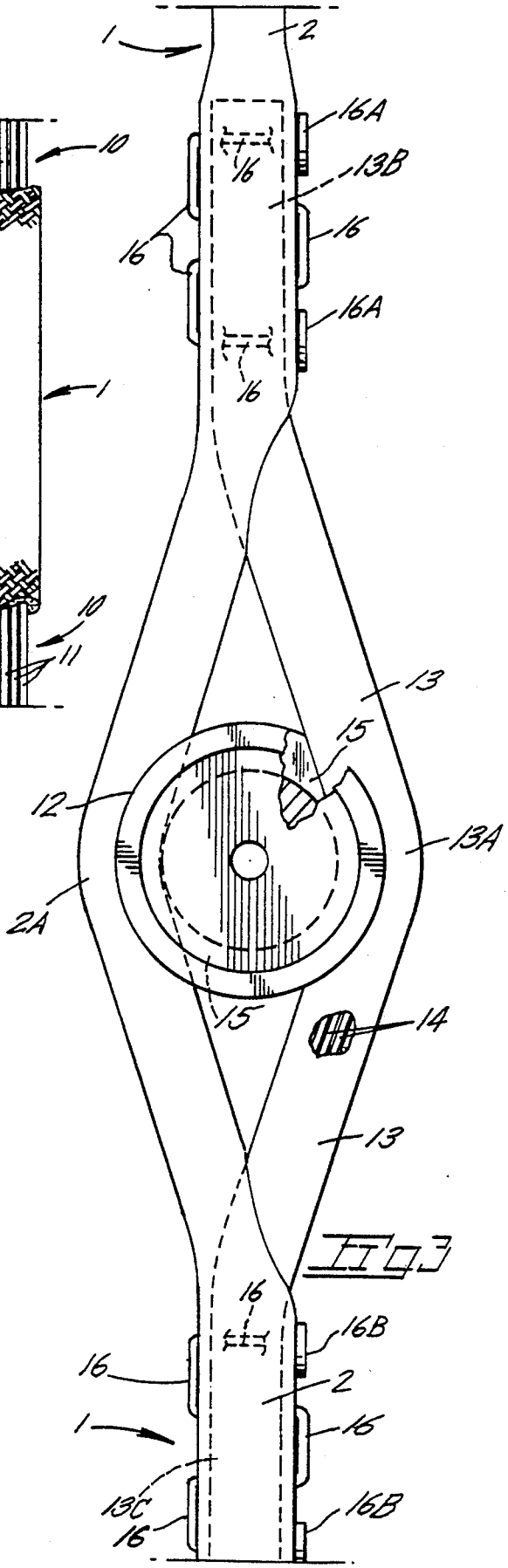
FIG. 3 is an elevational view of a fragment of a modified tensionable member with provision for retention of a peep sight.

With attention still to the drawings wherein the reference numeral 1 indicates generally the present tensionable member, a tubular braided outer member or component is shown at 2 and is of ultra high molecular weight of polyethylene synthetic fibers for use as a bowstring or as a cable in a compound bow. Braided member 2 has a low pick count which permits separation of the twisted strands for purposes later explained. A pick count of fourteen has been found suitable for braided member 2.

Indicated generally at 3 are loops at the ends of the tensionable member for attachment of the member to a bow either as a bowstring or as a cable of a compound bow. Each loop includes a reversed segment 4 terminating in an end segment 4A the latter for insertion past separated strands of the braided outer member.

A core generally at 10 of the tensionable member is preferably of raw fibers of the same type of synthetic material earlier noted. The several strands 11 of the core are confined in juxtaposition as by applying tension and then subjected to a lubricant and fed directly into the center of the braiding machine for over braiding of outer member 2. The core fibers are accordingly properly and evenly distributed during over braiding.

A pliant locking element 8 insertably engages both the main portion of the tubular member 2 and the end segment 4A also inserted therein. A preferred form of locking element is one of a fusible nature as for example one made of nylon filaments or of the above described synthetic material. The fusible material permits the locking element to be secured in place in tubular member 2 and inserted end segment 4A by the fusing of its ends at 8A–8B to form heads thereon. One suitable manner of installing pliant locking element 8 is by sewing same back and forth through member 2 and the end segment 4A and their core segments therein prior to fusing of the ends.

With further attention to the materials of the present tubular braided member at 2, the same may be of that fiber manufactured and sold under the registered trademark SPECTRA of Allied-Signal Inc. Such a material has an ultra high molecular weight, extended-chain polyethylene fiber with orientated polymer chains. The tubular member is of such fibers with a weight of 375 denier. The fibers are twisted and two-plied to assure consistency of braiding machine operation and to maintain an acceptable diameter.

A preferred core is of raw fibers of the material sold under the registered trademark SPECTRA of 1300 denier formed into ten or so separate strands which are held side-by-side by tensioning during lubricant application from which the material is directly routed to the open center of a braiding machine for over braiding.

For sight installation on the tensionable member, when used as a bowstring, a peep sight at 12 may be installed by means of a sight retainer member 13 which may be of the same construction as braided tubular member 2 and, like the tubular member, includes a core at 14 to provide a sight retainer member 13 of like tensile strength and diameter. The sight retainer member has a segment at 13A which cooperates with a segment 2A of tubular member 2 to grip peep sight 12 in place by means of a segment 13A and segment 2A of outer member 2 passing through an annular channel 15 in the peep sight outer wall. Sight retainer member 13 has end segments at 13B–13C which are inserted into tubular member 2 and each secured by a locking member 16 with fused heads 16A–16B of the type described above for securing of the loop end segments.

While a specific preferred fiber is noted above the present tubular member 2 may be formed from other high modular synthetic fibers such as those sold under the registered trademarks KEVLAR and NOMAX.

The braid design of the tubular member will use a low pick or weft count to minimize elongation of the fibers.

A method of constructing the present tensionable member includes the entraining of a core of synthetic fibers in the open center of a braiding machine and tensioning of the core to prevent subsequent displacement of core fibers during over braiding of same. An outer tubular member is subsequently braided by a braiding machine about the core with the combination of core and braided member severed at desired intervals. The reversible segments at each end of the tensionable member under construction are reversed with their end segments being inserted into the tubular outer component as by drawing of the end segments into place by a tool. Locking elements are inserted crosswise through the tubular outer core and through each end segment therein to maintain a loop configuration at the ends of the tensionable member. A preferred step of locking element installation includes sewing of the locking element into place.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A tensionable member for installation in an archery bow comprising, a tubular braided outer component of synthetic fibers, a core of synthetic fibers coterminous with said outer component, said tubular braided outer component having loops at its ends each formed by a reversed segment including an inserted end segment located lengthwise along and interiorly of the tubular braided outer component;

a locking element located transversely through said tubular braided outer component and said inserted end segment to lock the latter in place against extraction, said locking element is of a pliant fusible nature to permit fusing of the ends of said locking element for securement of same within the tubular braided outer component.

2. The tensionable member claimed in claim 1 wherein said core of synthetic fibers comprises multiple strands, a lubricant on said strands.

3. The tensionable member claimed in claim 1 additionally including a sight retainer member comprising a length of tubular braided material having end segments located lengthwise along and interiorly of said tubular braided outer component, pliant locking elements engageable with each of the last mentioned end segments of said sight retainer member and said tubular braided outer component.

4. The tensionable member claimed in claim 1 wherein said locking element is in sewn engagement with said tubular braided outer component.

5. The tensionable member claimed in claim 1 wherein said tubular braided outer component is of extended chain polyethylene fiber having oriented polymer chains to enhance the strength of said component.

6. The tensionable member claimed in claim 5 wherein said core is of extended chain polyethylene fiber having oriented polymer chains to enhance core strength.

7. A method of making a tensionable member for a bow comprising the steps of, braiding a tubular outer component over a core of synthetic fibers, severing the outer component and the core at corresponding intervals to provide reversible segments, each of said segments having an end segment, reversing said reversible segments, inserting the end segment of each of the reversible segments axially into and along said tubular outer component and therealong to form loops at the ends of the tensionable member, and inserting locking elements crosswise through said tubular outer component and through each end segment therein including the step of sewing the locking elements into place by passing the locking elements back and forth through said tubular outer component.

8. The method claimed in claim 7 including the installing of a sight retainer member of braided construction and having end segments and a core of synthetic fibers in place on said tubular outer component, including the steps of inserting each of said end segments axially into and along the tubular outer component and installing locking members through said braided member and the end segment therein.

9. The method claimed in claim 8 wherein the step of installing locking members includes sewing of the locking members into place by passage of the locking members back and forth through the tubular outer component and the end segment therein.

* * * * *